US012324501B2

(12) United States Patent
Lim

(10) Patent No.: US 12,324,501 B2
(45) Date of Patent: Jun. 10, 2025

(54) ON-DEMAND COSMETIC PACKAGING

(71) Applicant: Dong-Jin Lim, Birmingham, AL (US)

(72) Inventor: Dong-Jin Lim, Birmingham, AL (US)

( * ) Notice: Subject to any disclaimer, the term of this patent is extended or adjusted under 35 U.S.C. 154(b) by 22 days.

(21) Appl. No.: 18/300,273

(22) Filed: Apr. 13, 2023

(65) Prior Publication Data

US 2023/0329422 A1 Oct. 19, 2023

Related U.S. Application Data

(60) Provisional application No. 63/330,640, filed on Apr. 13, 2022.

(51) Int. Cl.
*A45D 37/00* (2006.01)

(52) U.S. Cl.
CPC ..... *A45D 37/00* (2013.01); *A45D 2200/1027* (2013.01); *A45D 2200/1036* (2013.01)

(58) Field of Classification Search
CPC ..... A45D 37/00; A45D 40/26; A45D 2200/1027; A45D 2200/1036; A47K 7/03; B65D 81/24
USPC ..... 206/581; 132/286–307, 312–318
See application file for complete search history.

(56) References Cited

U.S. PATENT DOCUMENTS

| | | | | |
|---|---|---|---|---|
| 6,062,234 | A * | 5/2000 | Finocchiaro | A45D 40/26 132/294 |
| 6,228,375 | B1 | 5/2001 | Kocher | |
| 6,322,271 | B1 * | 11/2001 | Girardot | A45D 40/26 401/265 |
| 6,406,206 | B1 * | 6/2002 | Girardot | A45D 40/26 15/104.93 |
| 6,945,402 | B1 * | 9/2005 | Gueret | B65D 81/3272 206/581 |
| 7,121,409 | B1 * | 10/2006 | Hamilton | B65D 75/366 206/484 |
| 7,987,985 | B2 | 8/2011 | Ede et al. | |
| 8,028,837 | B2 | 10/2011 | Gerstle et al. | |
| 10,779,630 | B2 * | 9/2020 | Oh | A45D 37/00 |
| 2009/0081266 | A1 | 3/2009 | Ying et al. | |
| 2012/0223099 | A1 | 9/2012 | Sanchez | |

* cited by examiner

*Primary Examiner* — Bryon P Gehman

(57) ABSTRACT

A cosmetic packaging comprising a single-use sachet for containing a cosmetic formulation. The single-use sachet comprises an enclosed section and an openable slit. The cosmetic formulation is contained within the enclosed section, only being able to escape the enclosed section once the openable slit is opened. The cosmetic packaging further comprises an application sheet and an outer pouch. The outer pouch comprises and openable end, surface walls, and an interior area. The single-use sachet and the application sheet are disposed within the outer pouch, allowing the cosmetic formulation to be applied to the application sheet immediately before removing the application sheet from the outer pouch.

18 Claims, 13 Drawing Sheets

ON-DEMAND COSMETIC PACKAGING

FIELD OF THE INVENTION

The present invention relates generally to packaging for cosmetics and more specifically to packaging for sealed cosmetic products capable of being unpacked and or combined onto an application sheet when needed.

BACKGROUND OF THE INVENTION

The skin is the largest organ of the human body and skin health can significantly affect quality of life by impacting psychosocial ability of individuals as well as other aspects of the individuals' health and well-being. Moreover, psychological stress affects the skin's health condition, impairing the permeability barrier homeostasis, the stratum corneum's (SC) integrity, and the immune system. Due to the dynamic nature of the skin over time, skin health should be appropriately managed to maintain normal sebum secretion. Environmental causes leading to skin damage—such as pollutants and ultraviolet light exposure, among others—contribute to skin health over time. Various skin care products can combat such external skin problems. Among them, facial masks and similar wetted sheets for other areas of the body are readily available and offer substantial positive effects for the skin. Numerous bioactive ingredients can be applied to cosmetic formulations, offering multifactional benefits, including rejuvenation, moisturization, exfoliation, whitening, and anti-wrinkling. Despite the clear benefits of these masks and sheets, many drawbacks exist. Some consumers feel uncomfortable applying a presoaked sheet to their skin due to the volume of typical cosmetic ingredients. Further, many bioactive ingredients are liable to environmental factors such as light, temperature, and oxygen, causing a mask/sheet or cosmetic formulation to often fail to be preserved in standard packaging. Additionally, a typical package or sheet cannot be used for multiple uses after being opened due to the potential for contamination issues.

The present application presents solutions to the above-referenced drawbacks of standard cosmetic packaging by utilizing an improved packaging system for cosmetic formulations and sheets. The present invention overcomes the issues and inconveniences of standard packaging by employing a single-dose package that can be easily opened and applied to the user.

DETAIL DESCRIPTIONS OF THE INVENTION

Figure 1:
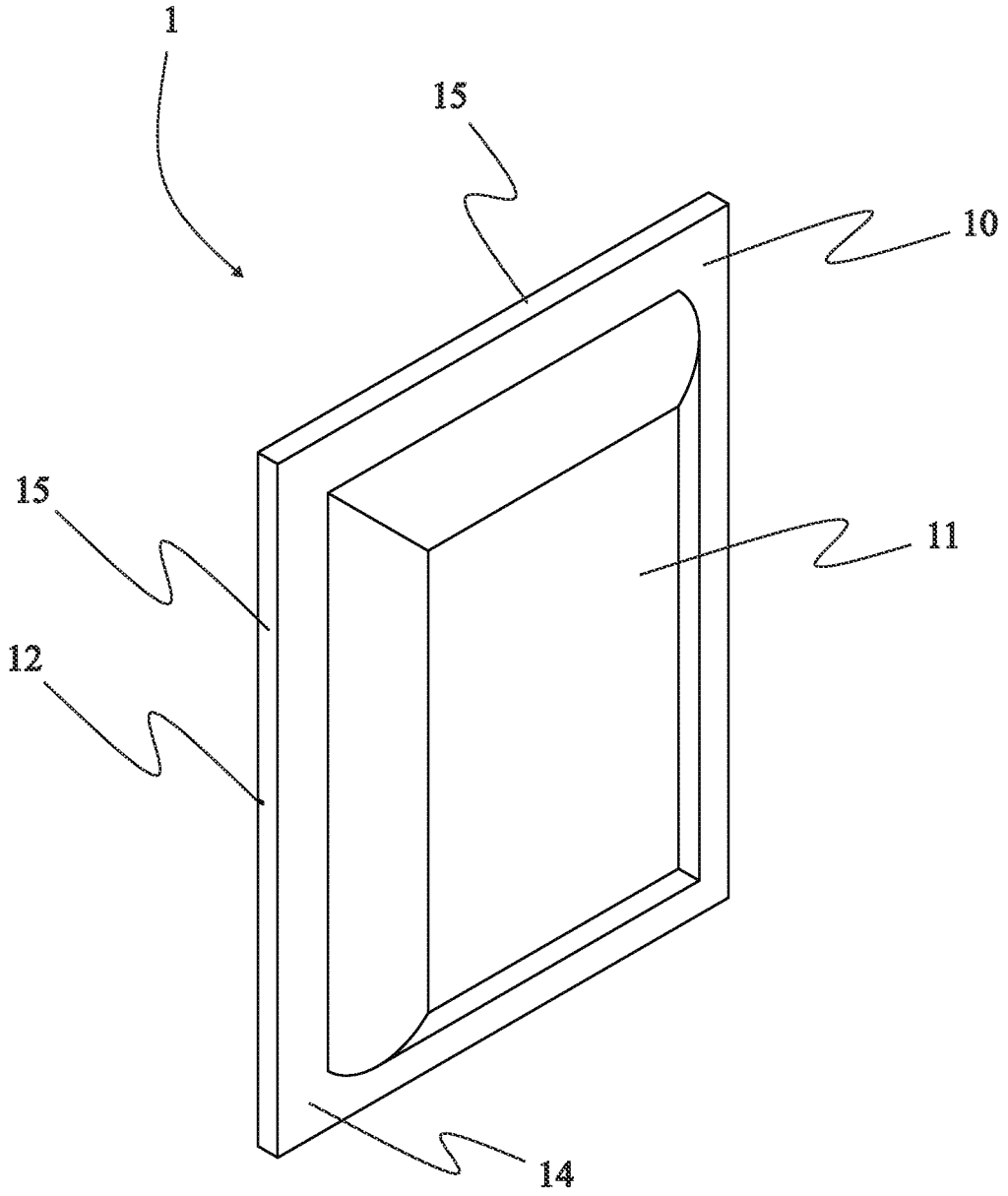
FIG. 1 is a top front isometric view of the single-use sachet of the present invention in accordance with at least one embodiment.
Figure 2:
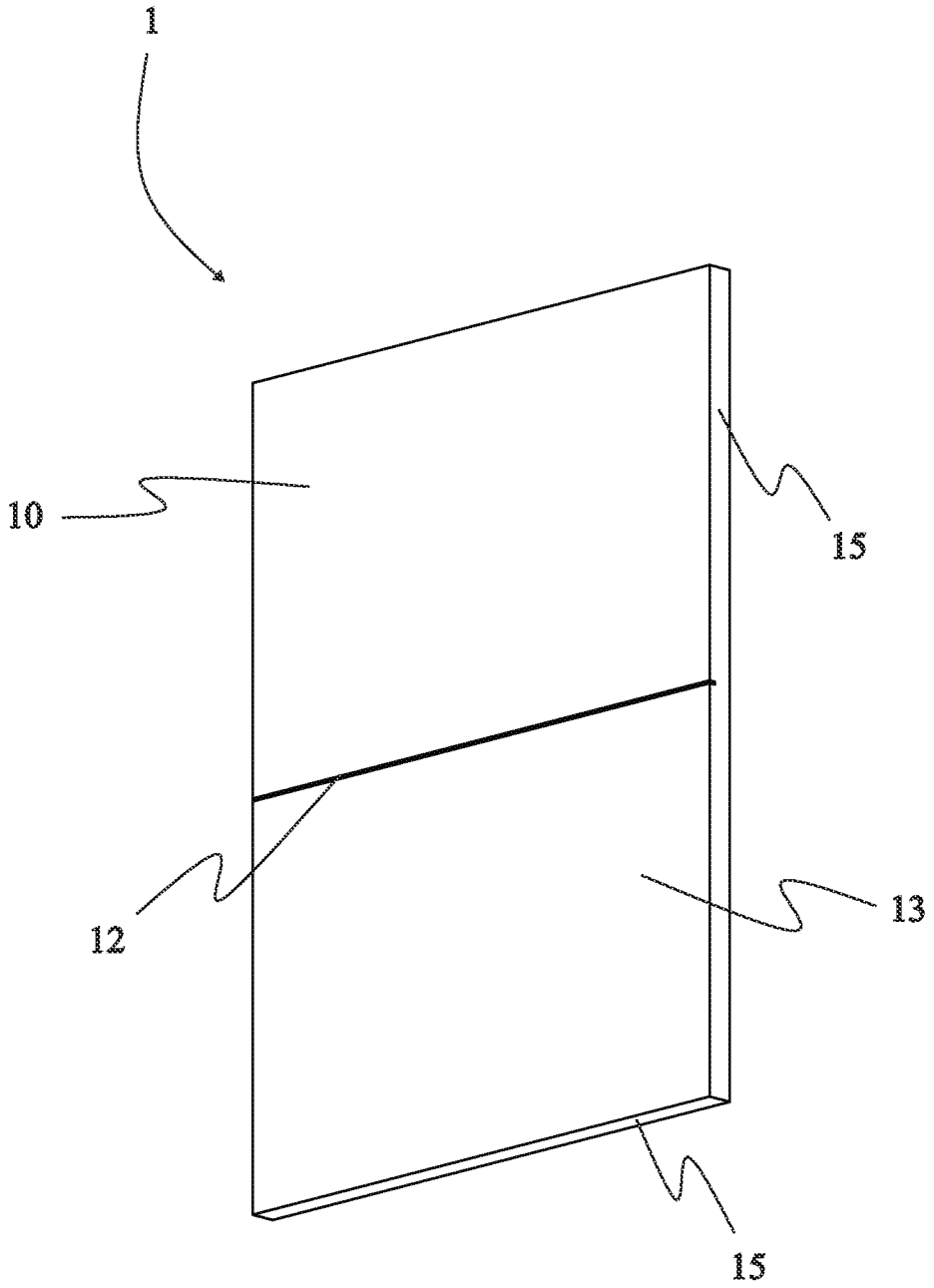
FIG. 2 is a bottom rear isometric view of the single-use sachet of the present invention in accordance with at least one embodiment.
Figure 3:
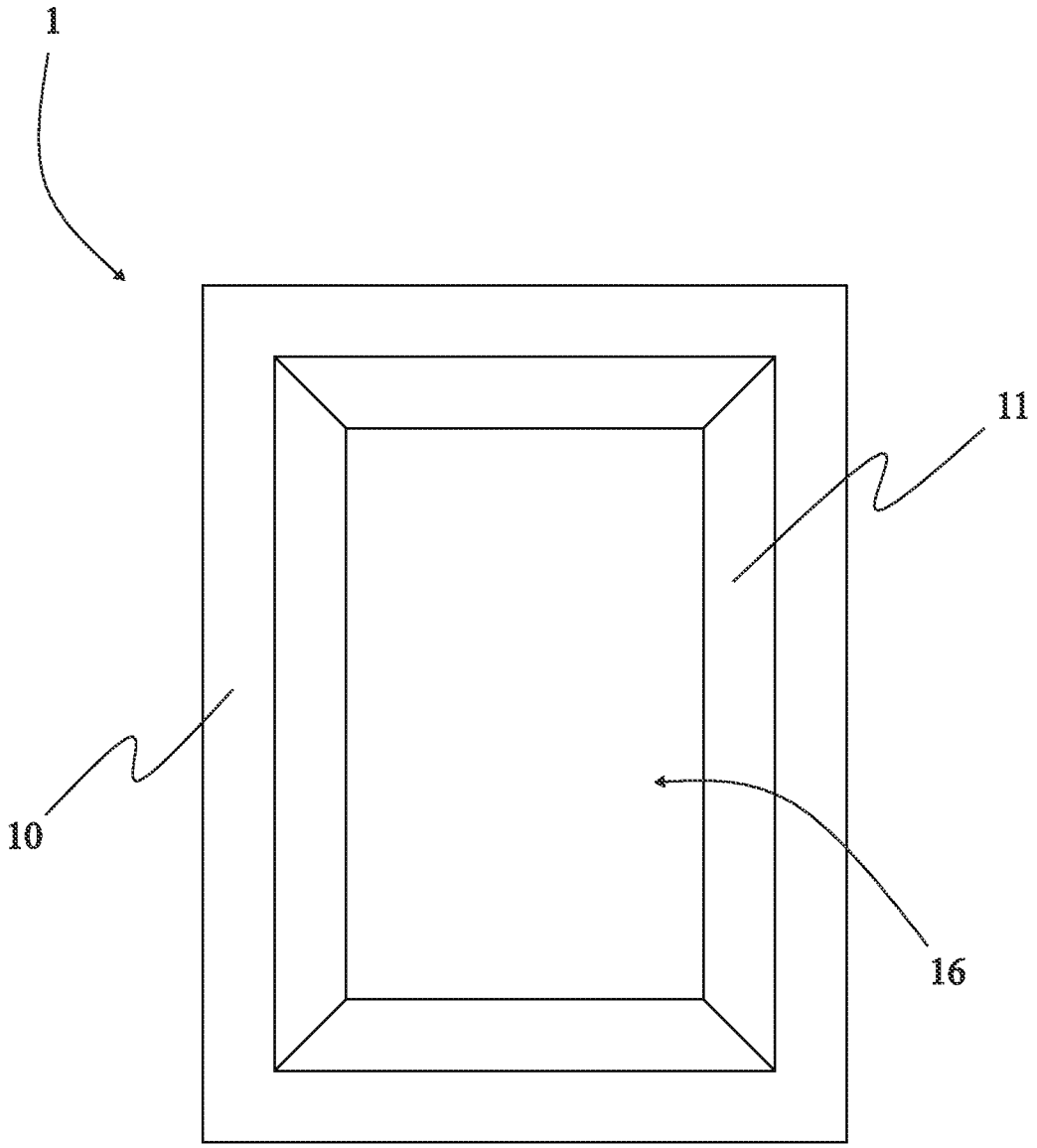
FIG. 3 is a front elevation view of the single-use sachet of the present invention in accordance with at least one embodiment.
Figure 4:
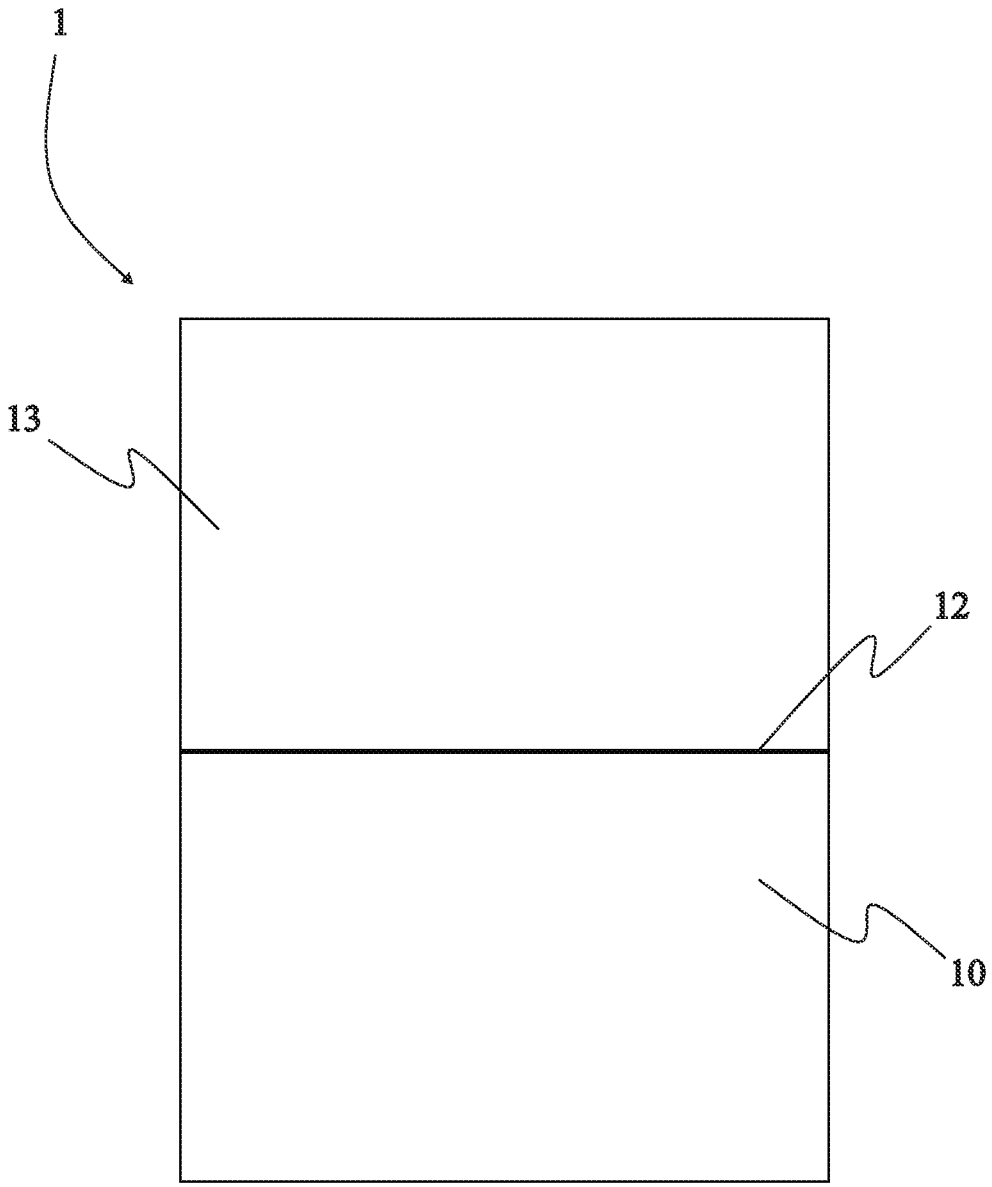
FIG. 4 is a rear elevation view of the single-use sachet of the present invention in accordance with at least one embodiment.
Figure 5:
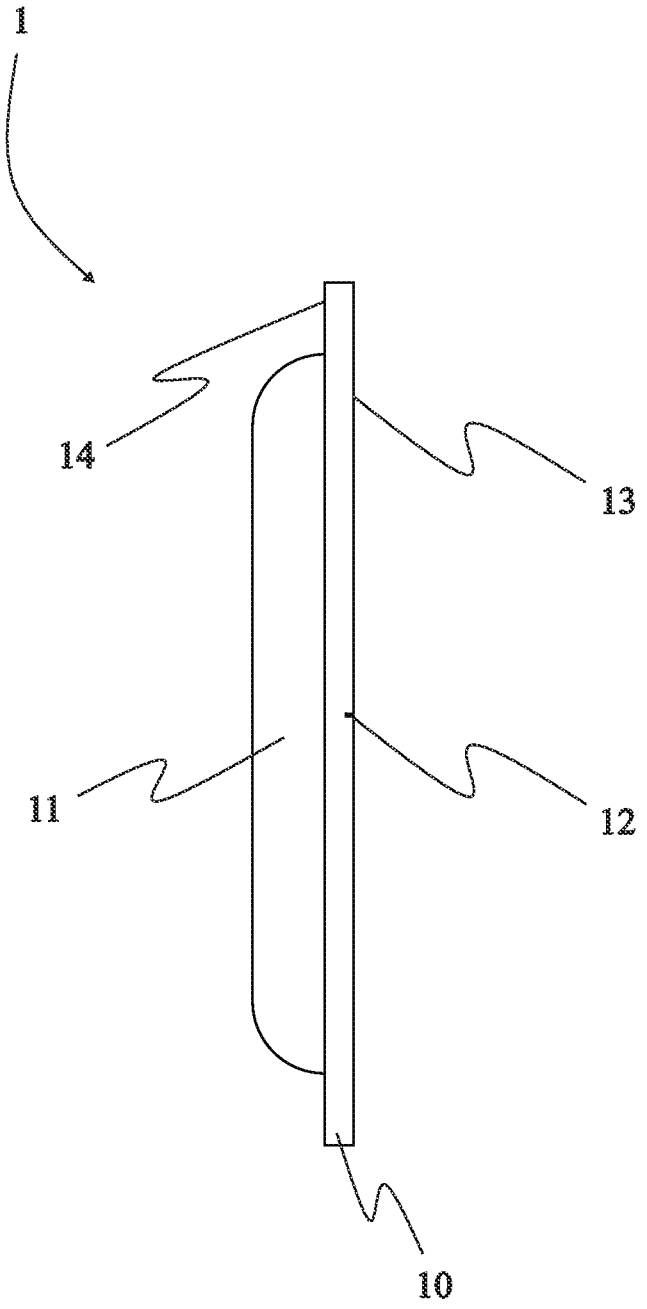
FIG. 5 is a side elevation view of the single-use sachet of the present invention in accordance with at least one embodiment.

All illustrations of the drawings are for the purpose of describing selected versions of the present invention and are not intended to limit the scope of the present invention.

The present invention is cosmetic packaging comprising a single-use sachet 1, a cosmetic formulation 16, an outer pouch 2, and an application sheet 4. In some embodiments, the present invention further comprises a frame 3, at least one additive cosmetic ingredient 5, at least one additional single-use sachet 6, and at least one additional frame 7. The packaging of the present invention allows for the cosmetic formulation 16 to be applied to the application sheet 4 on demand while keeping the cosmetic formulation 16 protected until needed.

Figure 13:
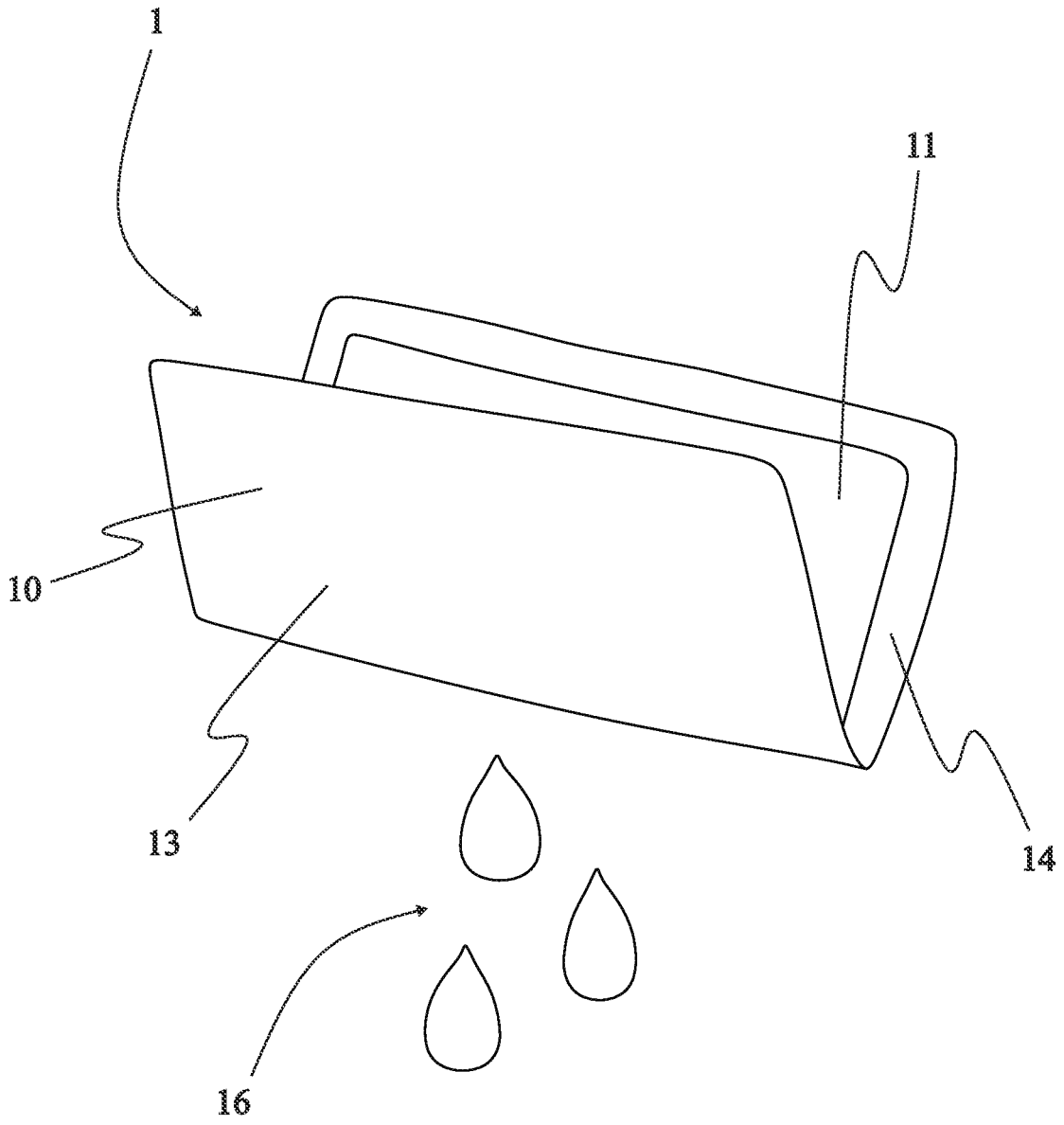
FIG. 13 is an illustration of the single-use sachet of the present invention being operated to release the cosmetic formulation in accordance with at least one embodiment.

Referring to FIG. 1-5, the single-use sachet 1 of the present application is an openable container used to contain the cosmetic formulation 16 of the present invention. The single-use sachet 1 comprises a structural layer 10, an enclosed section 11, an openable slit 12, and a plurality of sealed edges 15. The structural layer 10 is a semi-rigid material that provides structure to the single-use sachet 1 that is otherwise a flexible container. The structural layer 10 comprises a front side 13 and a back side 14. The enclosed section 11 is attached to the back side 14 of the structural layer 10 and the cosmetic formulation 16 is deposited within the enclosed section 11. The openable slit 12 is positioned on the front side 13 of the structural layer 10 and is configured to open when the structural layer 10 is folded towards the enclosed section 11. In the preferred embodiment, the openable slit 12 is positioned halfway along the length of the structural layer 10, such that folding the structural layer 10 in half opens the openable slit 12. When the openable slit 12 is opened, it creates a passage from the enclosed section 11 to the front side 13 of the structural layer 10, allowing the cosmetic formulation 16 to be released from the enclosed section 11. The plurality of sealed edges 15 perimetrically connects the enclosed section 11 to the structural layer 10, ensuring that the cosmetic formulation 16 cannot escape the enclosed section 11 except upon opening of the openable slit 12, as shown in FIG. 13.

The cosmetic formulation 16 of the present invention is any cosmetic ingredient or combination of cosmetic ingredients that can be applied to a user's skin. The cosmetic formulation 16 may include one or more of a solution, cream, emulsion, lotion, ointment, paste, suspension, tablet, powder, gel, stick, aerosol, or other similar formulation. The cosmetic formulation 16 is stored within the enclosed section 11 of the single-use sachet 1 to preserve the ingredients and prevent significant loss of bioactive drugs prone to external physiochemical stresses. When unopened, the enclosed section 11 is configured to keep the cosmetic formulation 16 separated from anything that may alter the effectiveness of the ingredients, such as light, oxygen, and various contaminants, as well as other additional cosmetic ingredients contained within the outer pouch 2. For example, in one instance, the cosmetic formulation 16 may be sealed in the single-use sachet 1 to retain the stability of vitamin C in the cosmetic formulation 16, since vitamin C decomposes when mixed with water and an aqueous solution may be present in the outer pouch 2.

Figure 6:
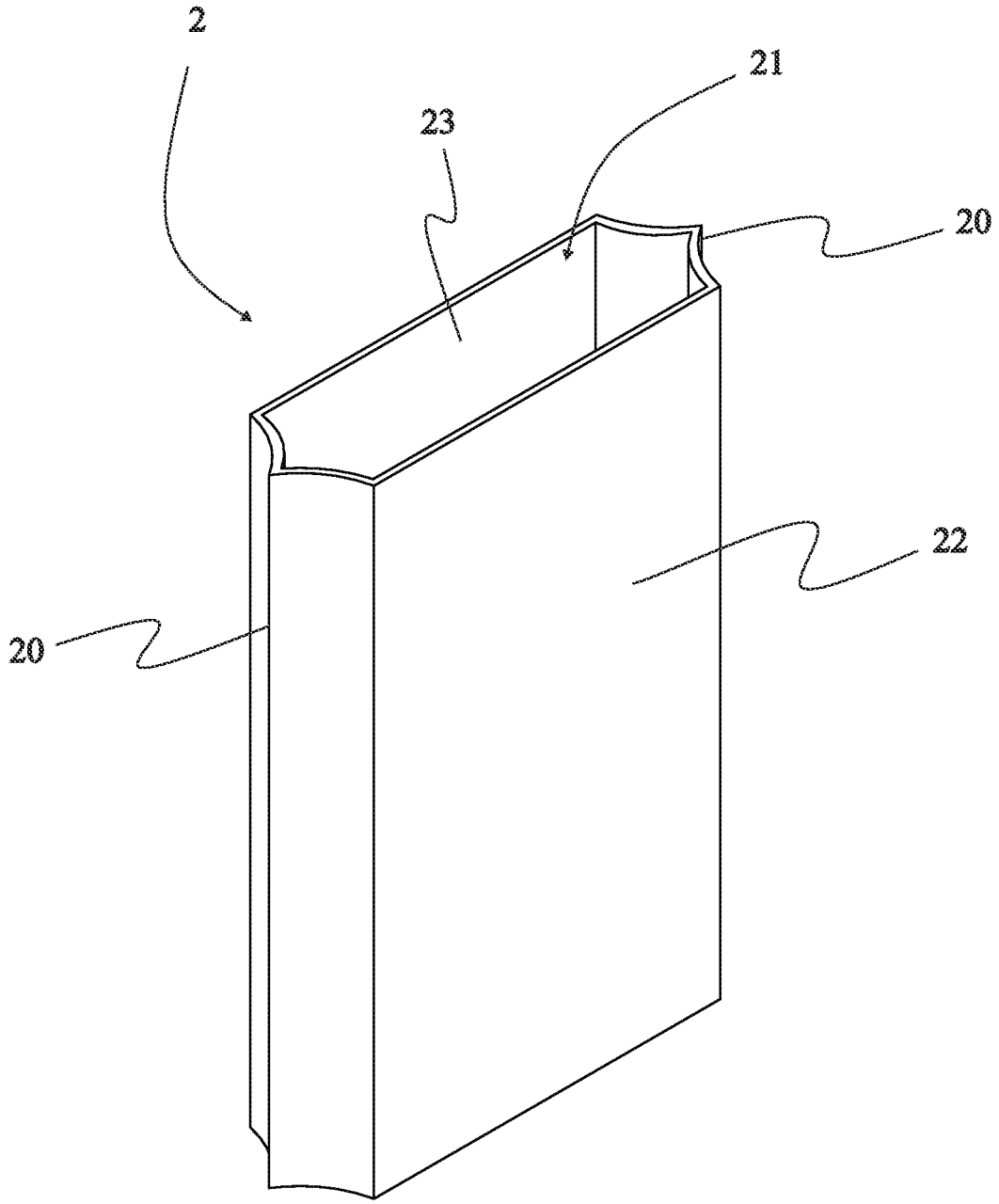
FIG. 6 is a top front isometric view of the outer pouch of the present invention in accordance with at least one embodiment.
Figure 7:
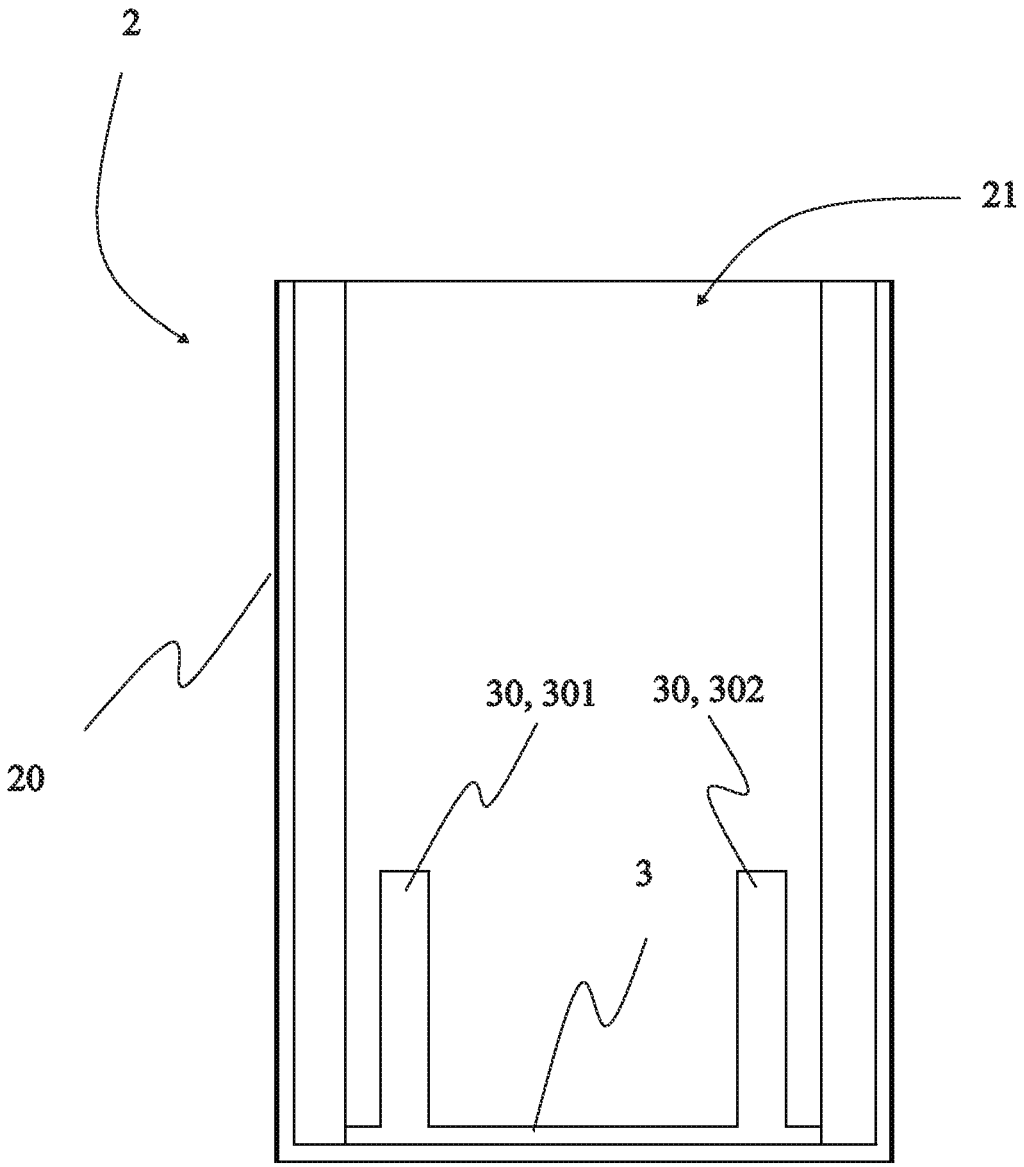
FIG. 7 is a section view of the outer pouch showing the frame of the present invention situated within the outer pouch in accordance with at least one embodiment.
Figure 8:
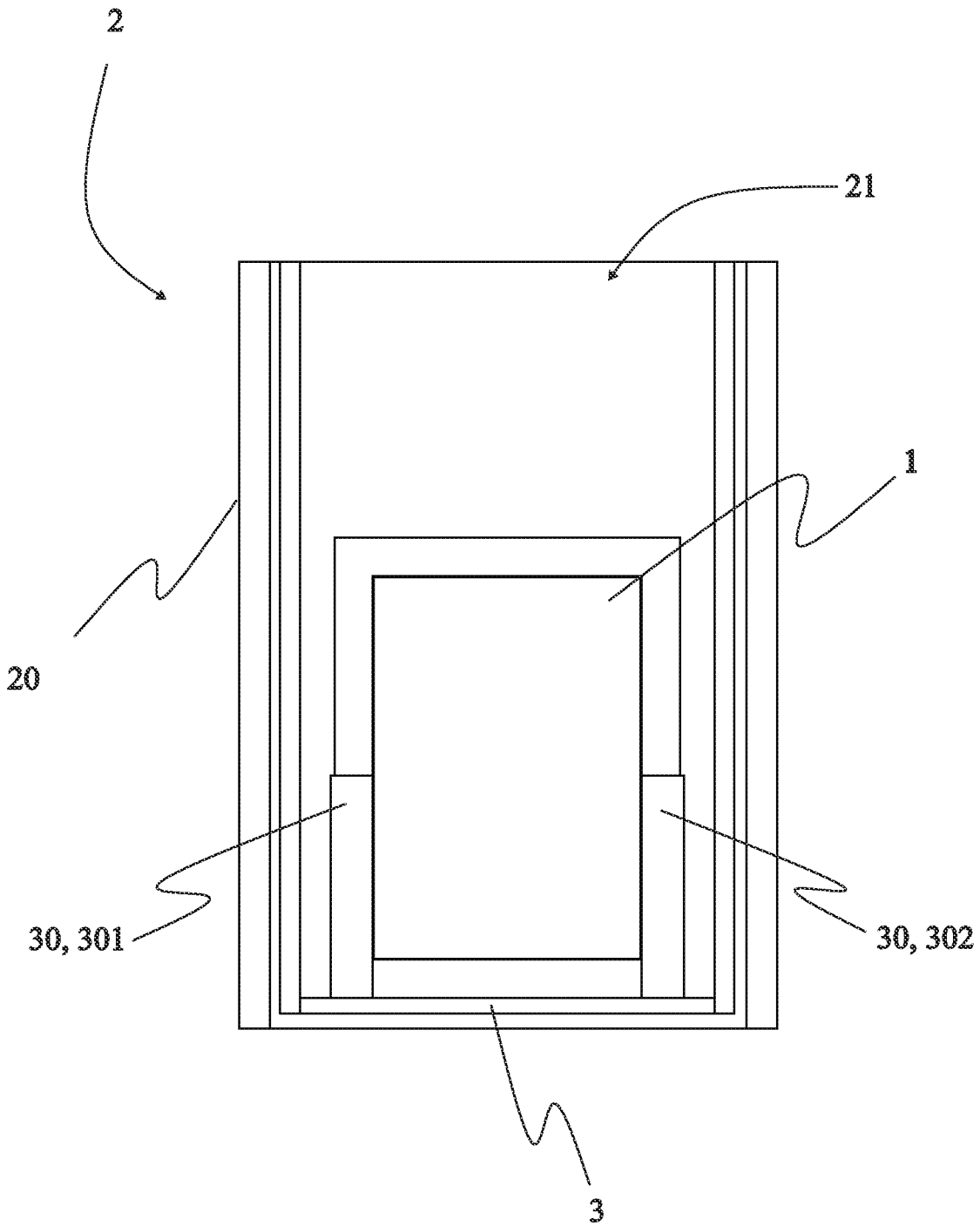
FIG. 8 is a section view of the outer pouch showing the frame and single-use sachet of the present invention situated within the outer pouch in accordance with at least one embodiment.
Figure 9:
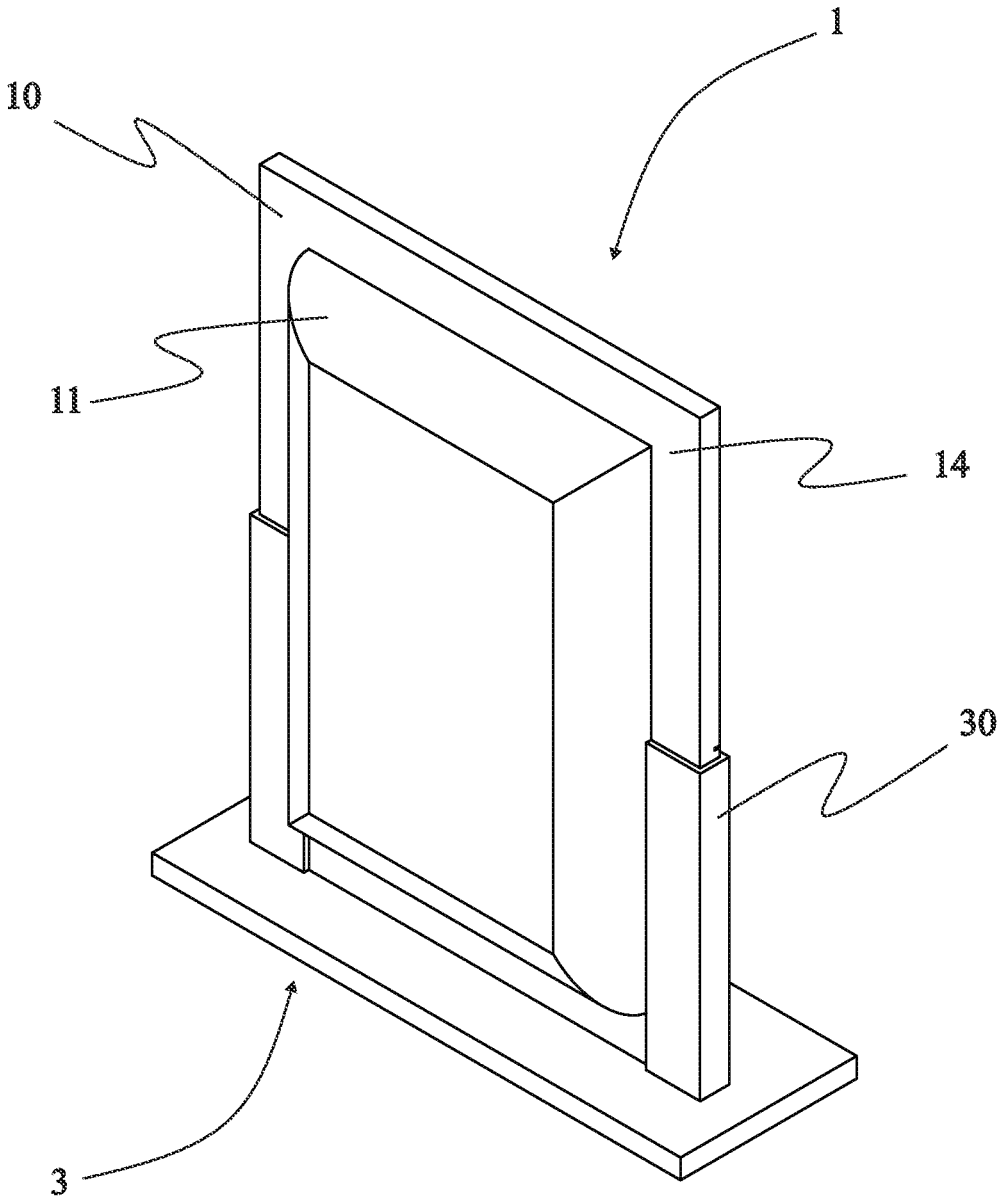
FIG. 9 is a top front isometric view of the single-use sachet engaged with the frame of the present invention in accordance with at least one embodiment.
Figure 10:
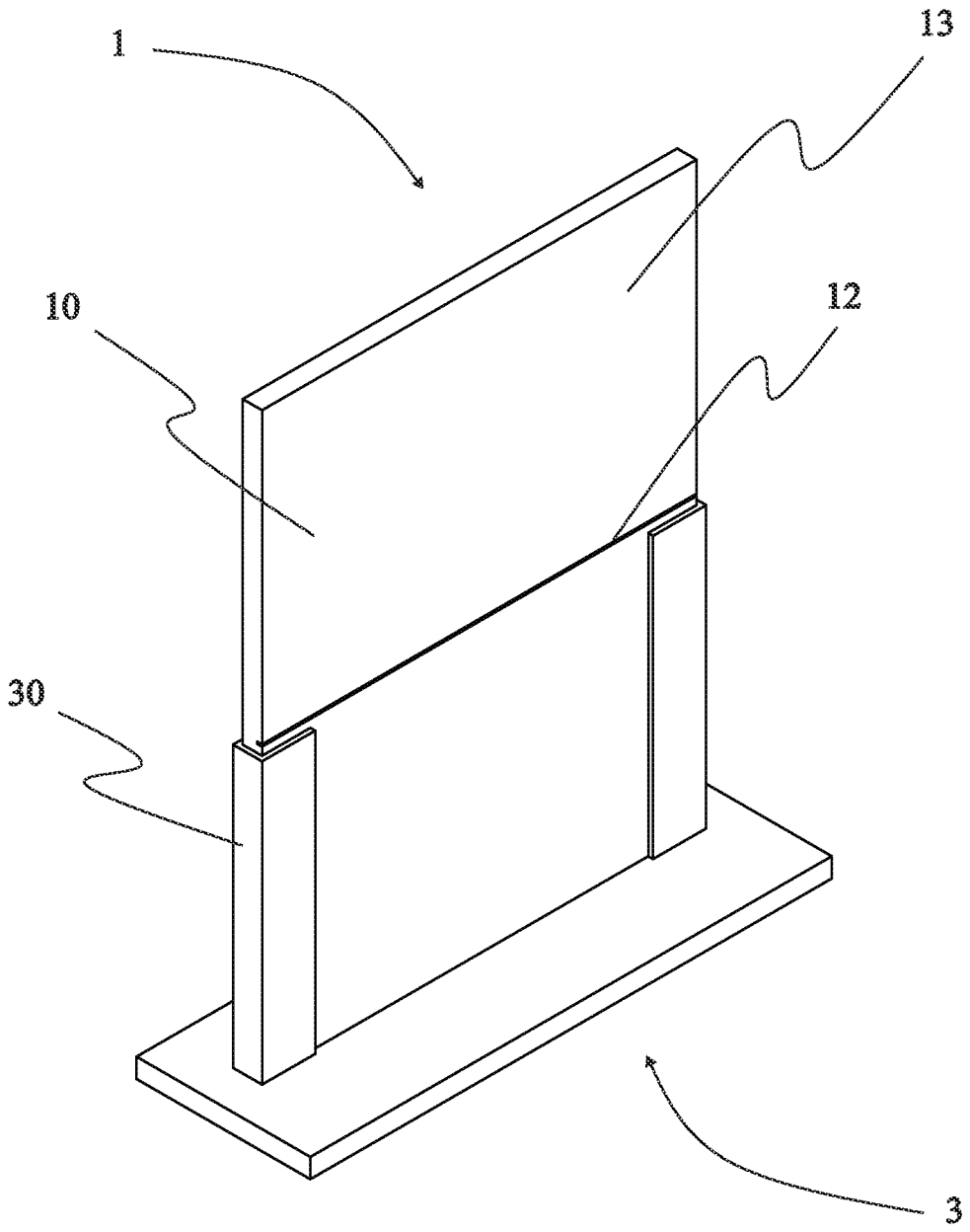
FIG. 10 is a top rear isometric view of the single-use sachet engaged with the frame of the present invention in accordance with at least one embodiment.

Referring to FIG. 6-8, the outer pouch 2 of the present invention is an openable pouch configured to contain the single-use sachet 1 of the present invention along with other components prior to use. The outer pouch 2 comprises a plurality of sealed sides 20, an openable end 21, surface walls 22, and an interior area 23. The outer pouch 2 may be flexible, allowing for bending and manipulation of the shape of the outer pouch 2. In the preferred embodiment, the outer pouch 2 is a barrier pouch having three sealed sides and one openable end 21, capable of securing smaller articles within the pouch. The openable end 21 is also sealed prior to use, but includes an opening mechanism to allow access to the interior area 23 of the outer pouch 2 through the open end. In some embodiments, the openable end 21 further comprises a sealing mechanism, allowing the openable end 21 to be resealed after use.

The frame 3 of the present invention, as seen in FIG. 7-10, may be used in conjunction with the outer pouch 2 to correctly orient the single-use sachet 1 within the outer pouch 2 for most effective use. The frame 3 comprises at least one gripping portion 30 configured to hold the single-use sachet 1 in place. In the preferred embodiment the at least one gripping portion 30 comprises a first gripping portion 301 and a second gripping portion 302. The first gripping portion 301 and the second gripping portion 302 may be U-shaped sleeves arranged to accept and secure the single-use sachet 1 at the plurality of sealed ends. In one embodiment, shown in FIG. 7-10, the frame 3 is disposed in the interior area 23 of the openable pouch attached to the surface walls 22 with the at least one gripping portion 30 extending upward into the interior area 23 within the outer pouch 2. The frame 3 may be arranged in any manner within the outer pouch 2, preferably orienting the openable slit 12 of the single-use sachet 1 toward the interior area 23 of the outer pouch 2, rather than toward the surface walls 22. For example, in one embodiment, the frame 3 may be attached to the surface walls 22 of the outer pouch 2 with the at least one gripping portion 30 being an adhesive substance holding the single-use sachet 1 against the surface walls 22 of the outer pouch 2.

Figure 11:
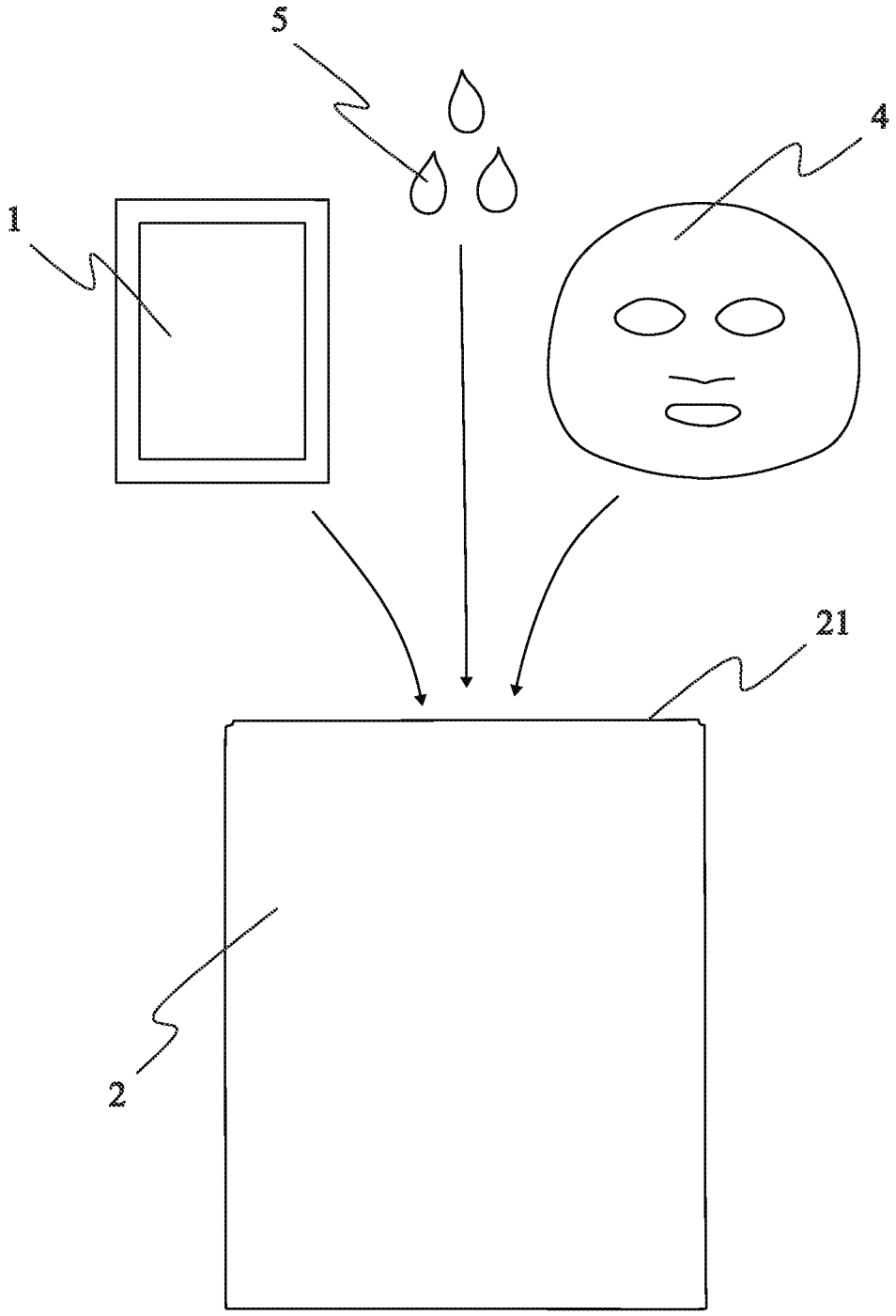
FIG. 11 is an illustration of the outer pouch of the present invention and the components contained within the outer pouch in accordance with at least one embodiment.

Referring to FIG. 11, in addition to the single-use sachet 1 and the frame 3, the outer pouch 2 may further contain an application sheet 4 and at least one additive cosmetic ingredient 5. The application sheet 4 is a thin, flexible sheet configured to carry the cosmetic formulation 16 and the at least one additive cosmetic ingredient 5 from the outer pouch 2 to the user's skin. In the preferred embodiment, the application sheet 4 is a cosmetic face mask, though the application sheet 4 may be any size and shape as required for other cosmetic purposes such as hand and foot care or general skin patches. Further, the present invention is not limited only to cosmetic purposes but may include pharmaceutical purposes or cosmeceuticals between the two categories. Examples of the types of ingredients included in the cosmetic formulation 16 and the at least one additive cosmetic ingredient 5 are vitamins, antioxidants, peptides, growth hormones, hydroxy acids, and botanicals. The ingredients of the cosmetic formulation 16 and the at least one additive cosmetic ingredient 5 are not limited to these, but may include any other active ingredients ranging from cosmetic products to cosmeceuticals to pharmaceuticals, as well as the variety of inactive ingredients included for desired formulations. The application sheet 4 is disposed within the interior area 23 of the outer pouch 2 and, depending on the size and shape of the application sheet 4, the application sheet 4 may be folded or otherwise manipulated to fit within the outer pouch 2 most effectively. The at least one additive cosmetic ingredient 5 may be any cosmetic ingredient intended for use with the application sheet 4, but not needing to be separately stored within the single-use sachet 1. Similar to the at cosmetic formulation 16, the at least one additive cosmetic ingredient 5 may come in a variety of forms including one or more of a solution, cream, emulsion, lotion, ointment, paste, suspension, tablet, powder, gel, stick, aerosol, or other similar formulation. The at least one additive cosmetic ingredient may be disposed freely within the interior area 23 of the outer pouch 2, separated from the cosmetic formulation 16 by the single-use sachet 1. In many cases, the at least one additive cosmetic ingredient 5 is one or more ingredients configured for chemically activating the cosmetic formulation 16. For example, in the case of the vitamin C-based cosmetic formulation 16 in the single-use sachet 1, the at least one additive cosmetic ingredient 5 may be a water-based solution meant to mix with the cosmetic formulation 16 immediately before being applied to the skin.

Figure 12:
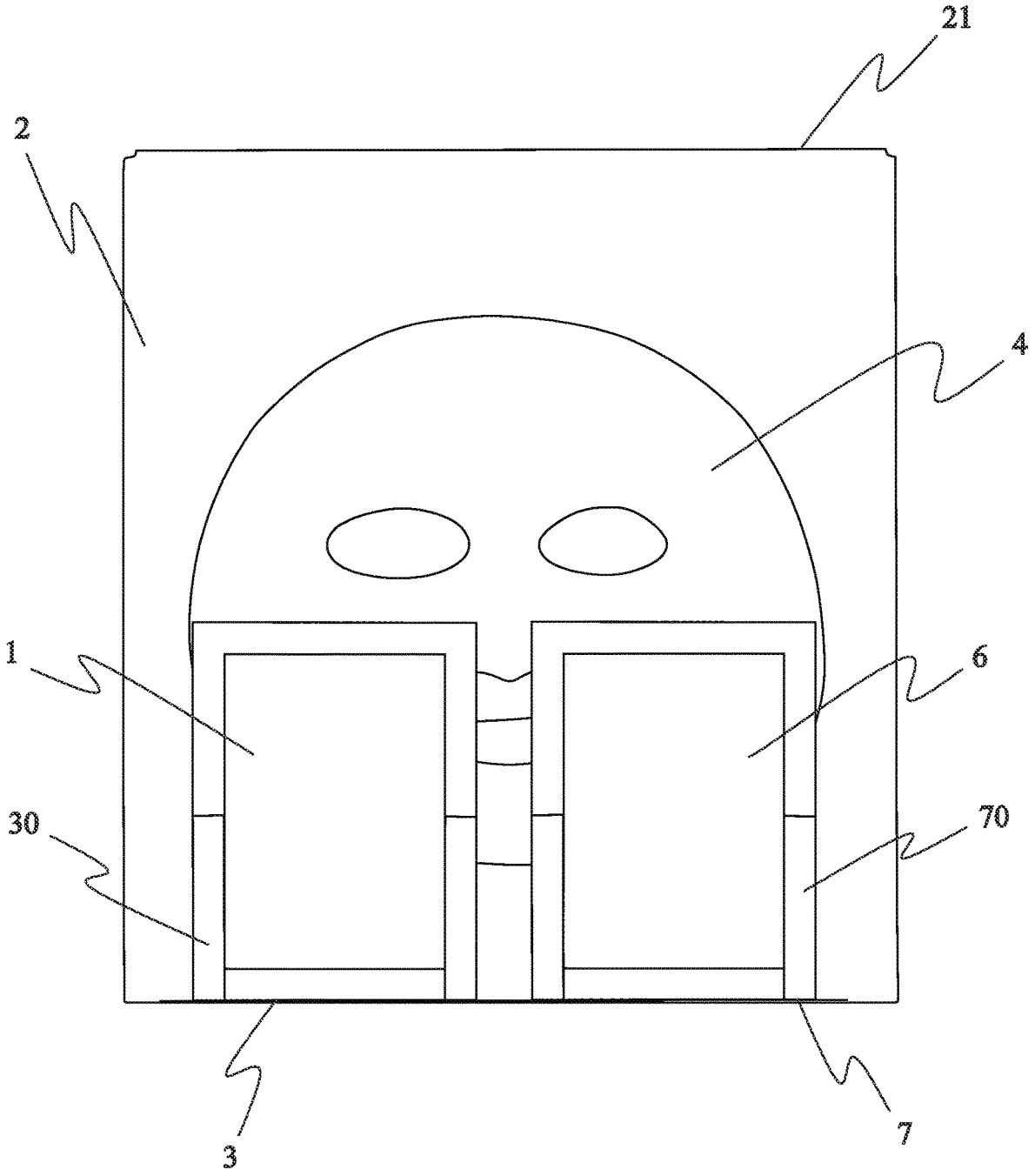
FIG. 12 is an illustration of the inside of the outer pouch containing multiple single-use sachets and the application sheet in accordance with at least one embodiment.

In some embodiments, as shown in FIG. 12, the present invention may further include at least one additional single-use sachet 6 and at least one additional frame 7. Each of the at least one additional single-use sachets 6 comprise the same components as the single-use sachet 1, including the enclosed section 11 and the openable slit 12 and each of the at least one additional frame 7 comprise the same components as the frame 3, including the at least one gripping portion 30. The at least one additional single-use sachet 6 may be necessary in cases where multiple components of the cosmetic formulation 16 need to be contained separately prior to use. This embodiment allows for consumers to customize the contents of the outer pouch 2 by selecting the how many additional single-use sachets 6 are included as well as the contents of each of the additional single-use sachets 6, and the contents of the at least one additive cosmetic ingredient 5.

In use, the outer pouch 2 initially has a sealed openable end 21 and contained within the outer pouch 2 is the single-use sachet 1, the cosmetic formulation 16 within the single-use sachet 1, and the application sheet 4 for receiving the cosmetic formulation 16. Additionally, the optional frame 3 may be included in the outer pouch 2 for orienting the single-use sachet 1 as well as the at least one additive cosmetic ingredient 5 for mixing with the cosmetic formulation 16. The user may open the single-use sachet 1 while it is still contained within the outer pouch 2 by folding the single-use sachet 1 within the outer pouch 2 and squeezing the cosmetic formulation 16 out of the single-use sachet 1. This can be done more effectively through the use of the frame 3, since the single-use sachet 1 will be correctly oriented within the outer pouch 2 prior to use. The cosmetic formulation 16 may then be mixed with the at least one additive cosmetic ingredient 5 by pressing, shaking, or otherwise manipulating the outer pouch 2. Through this mixing process, the cosmetic formulation 16 and the at least one additive cosmetic ingredient 5 soak onto or otherwise adhere to the application sheet 4 within the outer pouch 2. The outer pouch 2 may then be opened at the openable end 21 and the application sheet 4 may be removed from the outer pouch 2 and placed on the appropriate area of the skin, transferring the cosmetic formulation 16 to the skin for use.

Although the invention has been explained in relation to its preferred embodiment, it is to be understood that many other possible modifications and variations can be made without departing from the spirit and scope of the invention.

What is claimed is:

1. A cosmetic packaging, comprising:
a single-use sachet;
an outer pouch;
an application sheet;
a cosmetic formulation;
the single-use sachet comprising an enclosed section and an openable slit;
the cosmetic formulation being contained within the enclosed section;
the outer pouch comprising an openable end, surface walls, and an interior area;
the single-use sachet being disposed within the interior area of the outer pouch;
the application sheet being disposed within the interior area of the outer pouch;
a frame;
the frame attached to the surface walls of the outer pouch within the interior area of the outer pouch;
the frame comprising at least one gripping portion; and
the single use sachet being engaged with the at least one gripping portion.

2. The cosmetic packaging of claim 1, further comprising:
at least one additive cosmetic ingredient;
the at least one additive cosmetic ingredient disposed within the interior area of the outer pouch; and
the at least one additive cosmetic ingredient being physically separated from the cosmetic formulation by the single-use sachet.

3. The cosmetic packaging of claim 2, wherein the at least one additive cosmetic ingredient is configured for chemically activating the cosmetic formulation.

4. The cosmetic packaging of claim 1, further comprising:
the single-use sachet further comprising a structural layer and a plurality of sealed edges;
the structural layer having a front side and an oppositely positioned back side;
the enclosed section being attached to the back side of the structural layer;
the openable slit being positioned on the front side of the structural layer;
the openable slit being configured to open, creating a passage from the enclosed section to the front side of the structural layer; and
the plurality of sealed edges perimetrically connecting the enclosed section to the structural layer.

5. The cosmetic packaging of claim 1, further comprising:
at least one additional single-use sachet;
at least one additional frame;
the at least one additional single-use sachet comprising an enclosed section and an openable slit;
the at least one additional frame comprising at least one gripping portion;
the at least one additional frame attached to the surface walls of the outer pouch within the interior area of the outer pouch; and
the at least one additional single-use sachet being engaged with the at least one gripping portion of the at least one additional frame.

6. The cosmetic packaging of claim 1, further comprising:
the at least one gripping portion of the frame comprising a first gripping portion and a second gripping portion;
the first gripping portion and the second gripping portion each being U-shaped sleeves; and
the plurality of sealed edges of the single-use sachet being engaged with the first gripping portion and the second gripping portion.

7. The cosmetic packaging of claim 1, wherein the outer pouch is flexible.

8. The cosmetic packaging of claim 1, wherein the application sheet is a cosmetic face mask.

9. A cosmetic packaging, comprising:
a single-use sachet;
a cosmetic formulation;
the single-use sachet comprising an enclosed section, an openable slit, a structural layer, and a plurality of sealed edges;
the cosmetic formulation being contained within the enclosed section;
the structural layer having a front side and an oppositely positioned back side;
the enclosed section being attached to the back side of the structural layer;
the openable slit being positioned on the front side of the structural layer;
the openable slit being configured to open, creating a passage from the enclosed section to the front side of the structural layer;
the plurality of sealed edges perimetrically connecting the enclosed section to the structural layer;
an outer pouch;
a frame;
the outer pouch comprising an openable end, surface walls, and an interior area;
the single-use sachet being disposed within the interior area of the outer pouch;
the frame attached to the surface walls of the outer pouch within the interior area of the outer pouch;
the frame comprising at least one gripping portion; and
the single use sachet being engaged with the at least one gripping portion.

10. The cosmetic packaging of claim 9, further comprising:
an outer pouch;
an application sheet;
the outer pouch comprising an openable end, surface walls, and an interior area;
the single-use sachet being disposed within the interior area of the outer pouch; and
the application sheet being disposed within the interior area of the outer pouch.

11. The cosmetic packaging of claim 10, wherein the application sheet is a cosmetic face mask.

12. The cosmetic packaging of claim 9, further comprising:
an outer pouch;

at least one additive cosmetic ingredient;

the outer pouch comprising an openable end, surface walls, and an interior area;

the single-use sachet being disposed within the interior area of the outer pouch;

the at least one additive cosmetic ingredient disposed within the interior area of the outer pouch; and the at least one additive cosmetic ingredient being physically separated from the cosmetic formulation by the single-use sachet.

13. The cosmetic packaging of claim 12, further comprising:

the outer pouch being flexible; and the at least one additive cosmetic ingredient being configured for chemically activating the cosmetic formulation.

14. The cosmetic packaging of claim 9, further comprising:

the at least one gripping portion of the frame comprising a first gripping portion and a second gripping portion;

the first gripping portion and the second gripping portion each being U-shaped sleeves; and the plurality of sealed edges of the single-use sachet being engaged with the first gripping portion and the second gripping portion.

15. The cosmetic packaging of claim 9, further comprising:

at least one additional single-use sachet;

at least one additional frame;

the at least one additional single-use sachet comprising an enclosed section and an openable slit;

the at least one additional frame comprising at least one gripping portion;

the at least one additional frame attached to the surface walls of the outer pouch within the interior area of the outer pouch; and the at least one additional single-use sachet being engaged with the at least one gripping portion of the at least one additional frame.

16. A cosmetic packaging, comprising:

a single-use sachet;

an outer pouch;

a frame;

an application sheet;

a cosmetic formulation;

the single-use sachet comprising an enclosed section, an openable slit, a structural layer, and a plurality of sealed edges;

the structural layer having a front side and an oppositely positioned back side;

the enclosed section being attached to the back side of the structural layer;

the openable slit being positioned on the front side of the structural layer;

the openable slit being configured to open, creating a passage from the enclosed section to the front side of the structural layer;

the plurality of sealed edged perimetrically connecting the enclosed section to the structural layer;

the cosmetic formulation being contained within the enclosed section;

the outer pouch comprising an openable end, surface walls, and an interior area;

the single-use sachet being disposed within the interior area of the outer pouch;

the application sheet being disposed within the interior area of the outer pouch;

the frame attached to the surface walls of the outer pouch within the interior area of the outer pouch;

the frame comprising at least one gripping portion;

the at least one gripping portion of the frame comprising a first gripping portion and a second gripping portion;

the first gripping portion and the second gripping portion each being U-shaped sleeves;

the plurality of sealed edges of the single-use sachet being engaged with the first gripping portion and the second gripping portion;

the outer pouch being flexible; and the application sheet being a cosmetic face mask.

17. The cosmetic packaging of claim 16, further comprising:

at least one additional single-use sachet;

at least one additional frame;

the at least one additional single-use sachet comprising an enclosed section and an openable slit;

the at least one additional frame comprising at least one gripping portion;

the at least one additional frame attached to the surface walls of the outer pouch within the interior area of the outer pouch; and the at least one additional single-use sachet being engaged with the at least one gripping portion of the at least one additional frame.

18. The cosmetic packaging of claim 16, further comprising:

at least one additive cosmetic ingredient;

the at least one additive cosmetic ingredient disposed within the interior area of the outer pouch;

the at least one additive cosmetic ingredient being physically separated from the cosmetic formulation by the single-use sachet; and the at least one additive cosmetic ingredient being configured for chemically activating the cosmetic formulation.

* * * * *